US008938191B2

(12) United States Patent
Maruko

(10) Patent No.: US 8,938,191 B2
(45) Date of Patent: Jan. 20, 2015

(54) IMAGE FORMING APPARATUS

(75) Inventor: Masami Maruko, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 162 days.

(21) Appl. No.: 13/613,535

(22) Filed: Sep. 13, 2012

(65) Prior Publication Data

US 2013/0078015 A1 Mar. 28, 2013

(30) Foreign Application Priority Data

Sep. 22, 2011 (JP) ..... 2011-207680

(51) Int. Cl.
*G03G 15/20* (2006.01)

(52) U.S. Cl.
CPC .... *G03G 15/2085* (2013.01); *G03G 2215/0135* (2013.01)
USPC ..... 399/323

(58) Field of Classification Search
CPC ..... G03G 15/2085
USPC ..... 399/323
See application file for complete search history.

(56) References Cited

U.S. PATENT DOCUMENTS

| | | | | |
|---|---|---|---|---|
| 3,867,026 | A * | 2/1975 | Ogawa | 399/398 |
| 2011/0142480 | A1* | 6/2011 | Miyata et al. | 399/323 |
| 2011/0222921 | A1* | 9/2011 | Murakami et al. | 399/323 |
| 2013/0202331 | A1* | 8/2013 | Maruko | 399/323 |

FOREIGN PATENT DOCUMENTS

| | | | |
|---|---|---|---|
| JP | 2005-221775 | A | 8/2005 |
| JP | 2007-94327 | A | 4/2007 |
| JP | 2007-206153 | A | 8/2007 |
| JP | 2007-233228 | A | 9/2007 |
| JP | 2011-164260 | A | 8/2011 |

OTHER PUBLICATIONS

Japanese Notification of Reason for Refusal for Japanese Patent Application No. 2011-207680; Date of Dispatch: Sep. 17, 2013; with English Translation.

* cited by examiner

*Primary Examiner* — Ryan Walsh
(74) *Attorney, Agent, or Firm* — Cantor Colburn LLP

(57) ABSTRACT

The image forming apparatus according to the present invention has a fixing member and a paper separation part. The fixing member fixes an image by heating and applying a pressure to a sheet of printing paper S on which a toner image is transferred, while transferring the paper S. The paper separation part has a blower part and an air ejecting part that ejects the air sent out from the blower part against a paper outlet port of a nipping part N of the fixing member. The air ejection part has ribs that divide the air flow sent out from said blower part.

7 Claims, 9 Drawing Sheets

IMAGE FORMING APPARATUS

CROSS-REFERENCE TO RELATED APPLICATION

This application is based on Japanese Patent Application No. 2011-207680 filed on Sep. 22, 2011, the contents of which are incorporated herein by reference.

BACKGROUND

1. Technical Field

The present invention relates to an image forming apparatus.

2. Description of Related Arts

In an image forming apparatus such as a copying machine, printer, or facsimile machine, a toner image transferred onto printing paper is fixed under heat and pressure while the paper is passing through a fixing member. The paper on which the image is fixed then leaves the fixing member and is discharged to the outside of the image forming apparatus.

When the toner image transferred on the printing paper is heated and pressed, it occurs sometime that the toner melts to cause the paper to stick to the fixing member. In particular, it becomes more difficult to separate the paper from the fixing member when the paper is thin or when a large amount of toner is used. In order to prevent the sheet from sticking to the fixing member, an image forming apparatus typically has a paper separating means for separating the printing paper from the fixing member. For example, Japanese Unexamined Publication No. 2007-94327 discloses a means of blowing hot air between the printing paper and the fixing member as a paper separation means.

However, the image forming apparatus according to Japanese Unexamined Publication No. 2007-94327 may increase the air pressure of the space between the printing paper, the fixing member, and the paper separation means as the air is blown into all over the space between the printing paper and the fixing apparatus by the paper separation means and the air reflecting from the paper or the fixing member leaves no way for the air to escape. As a result, the velocity of the blown into the space between the printing paper and the fixing member by the paper separation means may drop, causing the printing paper not properly separating from the fixing member. On the other hand, if the air amount is increased in order to sustain the velocity of the air blown into, the heat in the air may adversely affect other components of the image forming apparatus. The present invention was made to solve the problems shown above. Thus, the object of the present invention is to provide an image forming apparatus that can prevent the increase of the air pressure of the space between the printing paper, the fixing member, and the paper separation means.

SUMMARY

In order to accomplish at least one of the objective mentioned above, an image forming apparatus that reflects one mode of the present invention comprises: a fixing member that fixes an image by heating and applying a pressure to a sheet of printing paper on which a toner image is transferred, while the sheet of printing paper is being transported; and a paper separation part having a blower part and an air ejecting part that ejects air sent out from said blower part against a paper outlet port of a nipping part of said fixing member; wherein said air ejection part has ribs that divides an air flow sent out from said blower part.

Said rib is preferably formed in an angle relative to said printing paper's transport direction at least in one direction when seen in a plan view of the printing paper.

Said rib preferably has an air sucking port to suck the air in the space between said paper separation part and said nipping parts's paper outlet port.

Said air sucking port is preferably formed on one side of said ribs facing the printing paper that passes through said nipping part.

Said air sucking port is preferably connected with the sucking port of said blower part.

Said image forming apparatus preferably has a ventilation tube for ejecting the air in the space between said printing paper separation part and said nipping part's paper outlet port to the outside of said image forming apparatus.

Said image forming apparatus preferably has a ventilation tube for connecting the space between said printing paper separation part and said nipping part's paper outlet port with the suction port of said blower part.

The air ejected toward the printing paper outlet port of the nipping part of said fixing member preferably flows along the image forming part of said image forming apparatus after it is reflected at said paper outlet of said nipping part until it is ejected to the outside of said image forming apparatus.

The objects, features, and characteristics of this invention other than those set forth above will become apparent from the description given herein below with reference to preferred embodiments illustrated in the accompanying drawings.

BRIEF DESCRIPTION OF THE DRAWINGS

The patent or application file contains at least one drawing executed in color. Copies of this patent or patent application publication with color drawling(s) will be provided by the Office upon request and payment of the necessary fee.

DETAILED DESCRIPTION

The embodiments of this invention will be described below with reference to the accompanying drawings.

(First Embodiment)

Figure 1:
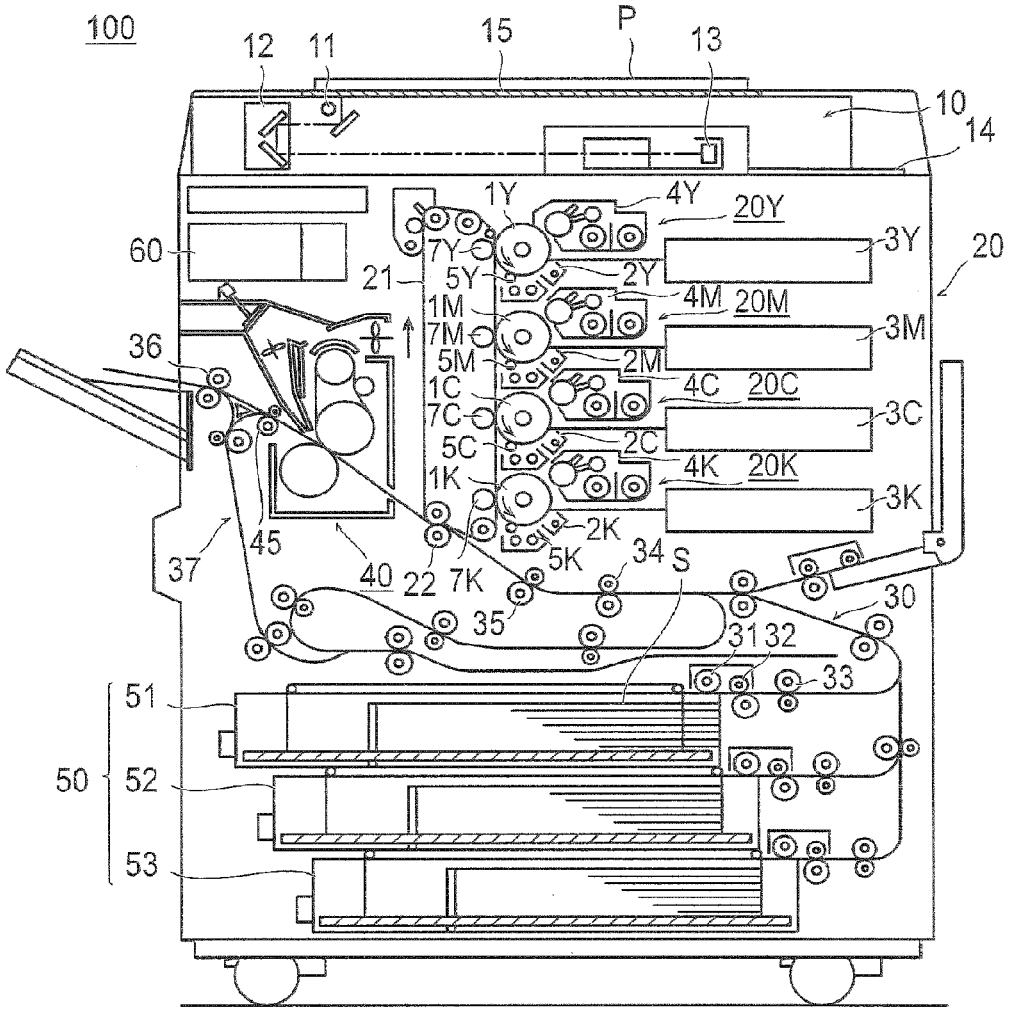
FIG. 1 is a rough cross-sectional view showing the total configuration of an image forming apparatus according to a first embodiment of the present embodiment.

The first embodiment of the present invention will be described below with reference to FIG. 1. FIG. 1 is a rough cross-sectional view showing the configuration of an image forming apparatus according to the first embodiment of the present embodiment. The image forming apparatus according to the present embodiment creates an air flow blown into the space between the printing paper and the fixing member by means of the paper separation part. The image forming apparatus according to the present embodiment is applicable to copying machines, printers, facsimile machines, and MFPs. In describing the present embodiment, a copying machine is used as the example of the image forming apparatus.

As shown in FIG. 1, the image forming apparatus 100 of the present embodiment has a document scanning part 10, an image forming part 20, a paper transport part 30, a fixing part 40, a paper supply part 50, and a control part 60. The following description will focus on the major composition of the image forming apparatus 100 of the present embodiment, and omit the description of the compositions identical to those of the conventional image forming apparatuses.

The image scanning part 10 scans the image of the document and stores it. The image scanning part 10 is equipped with a light source 11, an optical system 12, an imaging element 13, and an image processing system 14.

The light radiating from the light source 11 is reflected from a document P placed on a scanning plane 15, and the reflected light focuses via a lens and a reflection mirror of the optical system 12 on an imaging element 13 that is now moved to the scanning position. The imaging element 13 generates electric signals depending on the intensity of the light reflected from the document P. The generated electric signals are treated by a compensation process, a filtration process, an image compression process, and the like after having been converted from analog signals to digital signals in the image processing system 14, and are stored in the memory of the image processing system 14 as image data.

The image forming part 20 forms images by means of the electrophotographic process. The image forming part 20 of the present embodiment comprises an image forming part 20Y that forms an yellow (Y) color image, an image forming part 20M that forms a magenta (M) color image, an image forming part 20C that forms a cyan (C) color image, and an image forming part 20K that forms a black (K) color image. Here the common code 20 is followed by another code, Y, M, C, or K, which signifies the color of the corresponding signal.

The image forming part 20Y consists of a photoreceptor drum 1Y, i.e., a rotary member, a charging part 2Y provided on the periphery thereof, an optical writing part 3Y, a developing device 4Y, and a drum cleaner 5Y. The photoreceptor drum 1Y rotates at a specified speed driven by a drum motor.

Similarly, the image forming part 20M consists of a charging part 2M provided on the periphery of the photoreceptor drum 1M, an optical writing part 3M, a developing device 4M, and a drum cleaner 5M. Also, the image forming part 20C consists of a charging part 2C provided on the periphery of the photoreceptor drum 1C, an optical writing part 3C, a developing device 4C, and a drum cleaner 5C. Also, the image forming part 20K consists of a charging part 2K provided on the periphery of the photoreceptor drum 1K, an optical writing part 3K, a developing device 4K, and a drum cleaner 5K.

The photoreceptor drums 1Y, 1M, 1C, and 1K, the charging parts 2Y, 2M, 2C, and 2K, the optical writing parts 3Y, 3M, 3C, and 3K, the developing devices 4Y, 4M, 4C, and 4K, as well as the drum cleaners 5Y, 5M, 5C, and 5K, all of which corresponding to the image forming parts 20Y, 20M, 20C, and 20K respectively have common contents. Therefore, they are sometimes described in the following descriptions without specific codes Y, M, C, and K when it is not necessary to show their distinctions.

The image forming part 20 forms a latent image on the photoreceptor drum 1 by writing image information signals on the photoreceptor drum 1 with the optical writing part 3 based on the image data stored in the memory of the image processing system 14. The latent image is developed by the developing device 4 to form a toner image as a visible image on the photoreceptor drum 1.

Yellow (Y), magenta (M), cyan (C), and black (K) images are formed on the photoreceptor drums 1Y, 1M, 10, and 1K of the image forming parts 20Y, 20M, 20C, and 20K respectively.

An intermediate transfer belt 21 is supported and driven to turn around by a plurality of rollers. The toner images of various colors formed by the image forming parts 20Y, 20M, 20C, and 20K are transferred one by one onto the running intermediate transfer belt 21 by means of the primary transfer parts 7Y, 7M, 7C, and 7K to form a color image consisting of Y (yellow), M (magenta), C (cyan), and K (black) color layers overlaid one on top of each other.

The paper transport part 30 transports the printing paper S. The printing paper S is stored in a paper supply tray 51, 52 or 53 of the paper supply part 50. The paper transport part 30 is equipped with a send-out roller 31, a handling roller 32, a transport roller 33, a loop roller (intermediate roller) 34, a resist roller 35, a paper discharge roller 36, and a paper turning part 37.

The printing papers is sent out from the paper supply tray 51, 52, or 53 by means of the send-out roller 31 and separated into individual sheets by the handling roller 32. The printing paper S separated into individual sheets is transferred to a secondary transfer roller 22 via a loop roller 34 and a resist roller 35 along a transfer route by means of the transport roller 33.

The color image on the intermediate transfer belt 21 is transferred onto the printing paper S. The fixing part 40 applies heat and pressure on the printing paper S on which the color image is transferred to fix the toner image, after which the printing paper S is discharged via the paper discharge roller 36 to the outside of the image forming apparatus 100.

The air temperature inside the fixing part 40 increases while the toner image of the printing paper S is fixed. The air inside the fixing part 40 is exhausted to the outside of the fixing part 40 by means of an exhaust fan 46. In the present embodiment, the fixing part 40 is located adjacent to the image forming part 20, and the air to be exhausted by the exhaust fan 46 flows along the image forming part 20 to be exhausted finally to the outside of the forming apparatus 100. The details of the fixing part 40 of the present embodiment will be described later.

The image forming apparatus 100 is equipped with the paper turning part 37 so that it can guide the printing paper S on which the fixation is completed from a fixation transport roller 45 to the paper turning part 37 to have it flipped over before discharging it. This it is capable of forming images on both sides of the printing paper S.

The control part 60 controls the image scanning part 10, the image forming part 20, the paper transport part 30, the fixing part 40, and the paper supply part 50. The control part 60 is equipped with a CPU (Central Processing Unit), a RAM (Random Access Memory), and a ROM (Read Only Memory). The CPU controls the image scanning part 10, the image forming part 20, the paper transport part 30, the fixing part 40, and the paper supply part 50, and stores the arithmetic results and others on the RAM in accordance with the software program stored in the ROM.

Figure 2A:
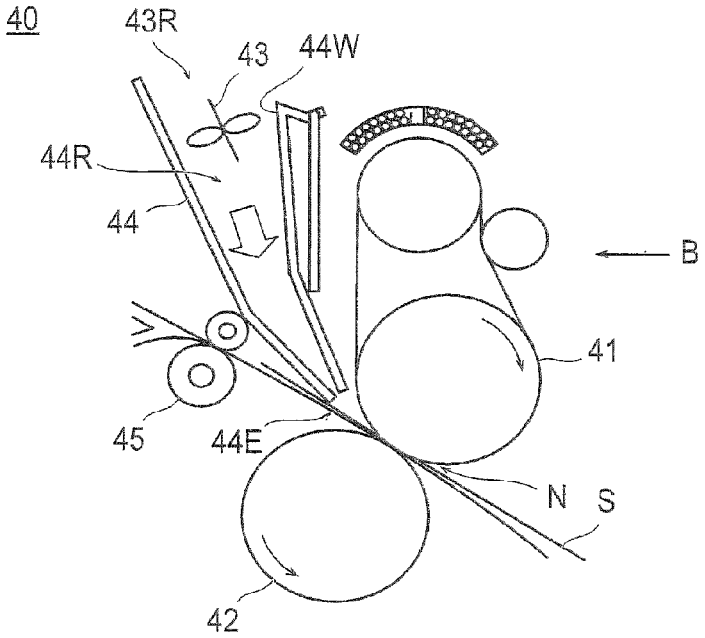
FIG. 2A is an enlarged cross-sectional view for describing the fixing part shown in FIG. 1.

The fixing part of the image forming apparatus of the present embodiment will be described in detail in the following with reference to FIG. 2A. FIG. 2A is an enlarged cross-sectional view for describing the fixing part shown in FIG. 1.

As shown in FIG. 2A, the fixing part 40 of the image forming apparatus 100 of the present embodiment is equipped with a heating roller 41, a pressure roller 42, a fan 43, and a nozzle 44.

The heating roller 41 heats the printing paper S on which the toner image is transferred while it is being transported. The heating roller 41 is formed by coating the surface of a cylindrically formed core metal made of aluminum, iron and other metals with a mold releasing layer containing fluorine resins such as PFA (perfluoroalkoxy), PTFE (polytetrafluoroethylene), etc. The heating roller 41 contains a heating means such as a halogen heater. In case of the present embodiment, the heating roller 41 rotates clockwise as shown by the arrow in the drawing.

The pressure roller 42 applies pressure to the printing paper S on which the toner image is transferred while it is being transported. The pressure roller 42 is formed by coating a cylindrically formed core metal made of stainless and other metals with an elastic layer containing a foaming agent such as silicon rubber and a mold separating layer. The pressure roller 42 applies pressure to the heating roller from underneath energized by an energizing member (not shown). In the meanwhile, a nipping part N is formed as the pressure roller 42 makes a pressuring contact with the heating roller 41. In case of the present embodiment, the pressure roller 42 rotates counterclockwise opposite to the rotation of the heating roller 41. As such, the heating roller 41 and the pressure roller 42 function as the fixing member and apply heat and pressure to the printing paper S on which the toner image is transferred simultaneous with the transportation of the printing paper S.

The fan 43 sucks air through the fan suction port 43R and sends out a specified amount of air to the nozzle 44. The fan 43 functions as the blower part in the present embodiment. A sirocco fan, for example, can be used as the fan 43. In the present embodiment, the amount of air sent out from a fan, not requiring a compressor, is sufficient for the purpose of the present embodiment as it can prevent the rise of the air pressure in the space between the printing paper S, the heating roller 41, as well as the pressure roller 42, and the nozzle 44. The fan 43 is controlled by the control 60 to rotate at a specified speed.

The nozzle 44 is controlled to eject air toward the nipping part N. The nozzle 44 functions as the air ejection part in the present embodiment. More specifically, the nozzle 44 ejects the air sent out from the fan 43 towards the paper outlet of the nipping part N formed by the heating roller 41 and the pressure roller 42.

The nozzle 44 sucks the air from the fan 43 through the air intake port 44R and ejects it from the air ejection port 44E. In the present embodiment, the outer wall of the nozzle 44 is formed in such a way as to make the cross-section of the nozzle 44 to shrink as it approaches the air ejection port 44E from the air intake port 44R. The air ejection port 44E of the nozzle 44 is arranged to face the paper outlet of the nipping part N.

The printing paper S on which the toner image is transferred is sent into the nipping part N of the fixing part 40 thus constituted. The printing paper S sent into the nipping part N advances from the paper outlet port of the nipping part N toward the fixation transport roller 45 after the image is fixed by means of the heating roller 41 and the pressure roller 42 simultaneous with its transportation. On the other hand, in the nozzle 44, the air sent out from the fan 43 (refer to the solid-white arrow in FIG. 2A) raises its speed as it is compressed inside the nozzle 44 and is ejected toward the printing paper S at the paper outlet of the nipping part N. Consequently, the printing paper S is separated from the heating roller 41.

Figure 2B:
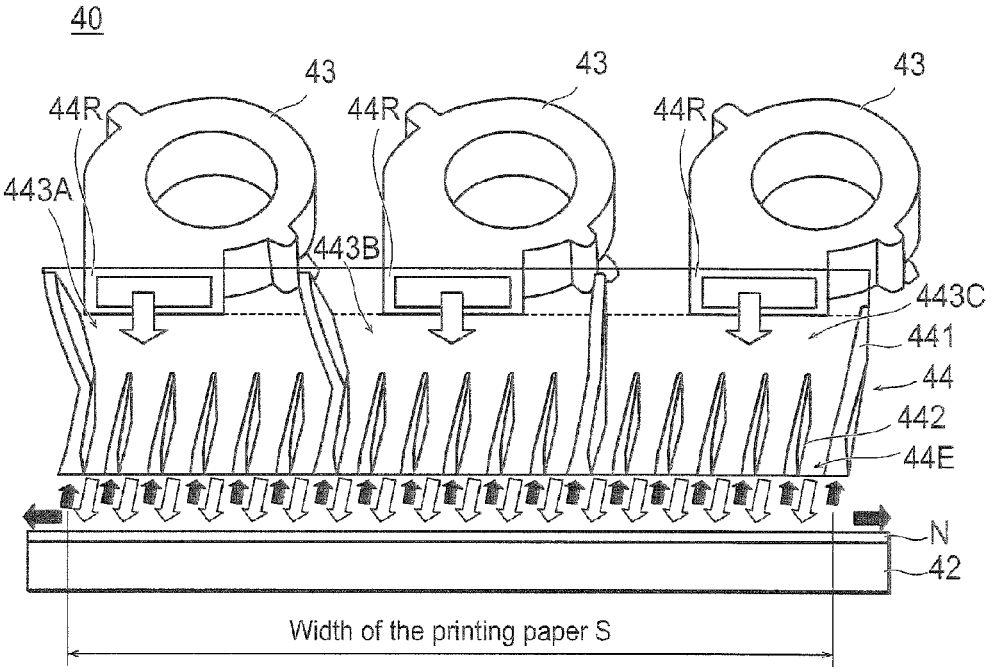
FIG. 2B is a rough perspective view of the nozzle of the fixing part viewed from the B-direction in FIG. 2A.

The nozzle structure of the present embodiment will be described in detail in the following with reference to FIG. 2B. FIG. 2B is a rough perspective view of the nozzle of the fixing part viewed from the B-direction in FIG. 2A. The outer wall 44W of the nozzle is not shown in FIG. 2B for the convenience of describing the internal structure of the nozzle.

As shown in FIG. 2B, the nozzle 44 of the present embodiment has a width wider than the width of the printing paper S, and is positioned to face the pressure roller 42, where three fans 43 are connected at the air intake port 44R. The nozzle 44 also has four pieces of primary ribs 441 protrusively formed extending along the paper transport direction from the air ejection port 44E to the three fans 43. The four primary ribs 441 divide the inside of the nozzle 44 into three spaces 443A, 443B, and 443C corresponding to three fans 43. Thus, the nozzle 44 provides three independent air passages corresponding to the three fans 43.

The nozzle 44 further has a total of 15 pieces of secondary ribs 442 protrusively formed extending along the paper transport direction from the air ejection port 44E to specific positions inside the nozzle 44. In the present embodiment, the spaces between adjacent secondary ribs 442 are generally equal along the direction of the paper transportation direction. Thus, the 15 secondary ribs 442 divide the portion of the space extending from the air ejection port 44E to the specific position of each of the three spaces 443A, 443B, and 443C into six spaces.

Therefore, the air sent out from a single fan 43 is ejected from the air ejection port 44E divided into six air passages. In FIG. 2B, the air flows from three fans 43 and the air flows from the air ejection port 44E are shown in solid-white arrows respectively. As such, in the present embodiment, the internal space of the nozzle 44 is divided by the primary and secondary ribs 441 and 442 in the present embodiment and the air sent out from the fans 43 is ejected through the air ejection port 44E with smaller cross-sectional areas, so that the air velocity increases.

Moreover, in the present embodiment, the air pressure of the space formed by the primary and secondary ribs 441 and 442 between the nozzle 44 and the nipping part N is lower than the air pressure where the primary and secondary ribs 441 and 442 are not formed. This is because the pressure of the air ejected from an area where the primary and secondary ribs 441 and 442 are not formed, i.e., the air ejection port 44E, is higher.

Therefore, the air ejected from the air ejection port 44E impinges upon the printing paper S at the paper outlet port of the nipping part N and reflects from it to advance further to the primary and secondary ribs 441 and 442 of the nozzle 44 (see the arrows of FIG. 2B). It then flows along the outer wall of the nozzle 44 and mixes with the air inside the fixing part 40. A portion of the reflected air flows along the longitudinal direction of the pressure roller 42 and mixes with the air inside the fixing part 40. The air inside the fixing part 40 is exhausted to the outside of the fixing part 40 by means of an exhaust fan 46.

As can be seen from the above, the image forming apparatus 100 according to the present embodiment causes the air that impinges upon the printing paper Sat the paper outlet port of the nipping part N to flow along the outer wall of the nozzle 44, thus securing the flow that is exhausted to the outside of the fixing part 40. Consequently, it can suppress the rise of the air pressure in the space between the printing paper S, the heating roller 41, as well as the pressure roller 42, and the nozzle 44. As a result, the reduction of the air velocity that impinges upon the printing paper S can be effectively prevented so that the printing paper S can be securely separated from the heating roller 41.

Moreover, by dividing the inside of the nozzle 44 into a plurality of wind passages, the velocity of the air that is ejected toward the nipping part N is increased. As a result, it is possible to separate the printing paper S with a small amount air that is sent out from the fan 43. Consequently, it is not necessary to increase the amount of the air to maintain the velocity of the air impinging upon the printing paper S, and it is possible to prevent the heat generated in the fixing part 40 from being dissipated to other components such as the image forming part 20.

(Second Embodiment)

In the first embodiment, a case was described wherein the primary and secondary ribs were formed to extend from the air ejection port of the nozzle along the paper transport direction. In the second embodiment, a case of forming the primary and secondary ribs extending from the air ejection port of the nozzle along a direction diagonal to the paper transport direction was described. In the following, the descriptions of the compositions similar to those of the first embodiment will be omitted in order to avoid duplications.

Figure 3A:
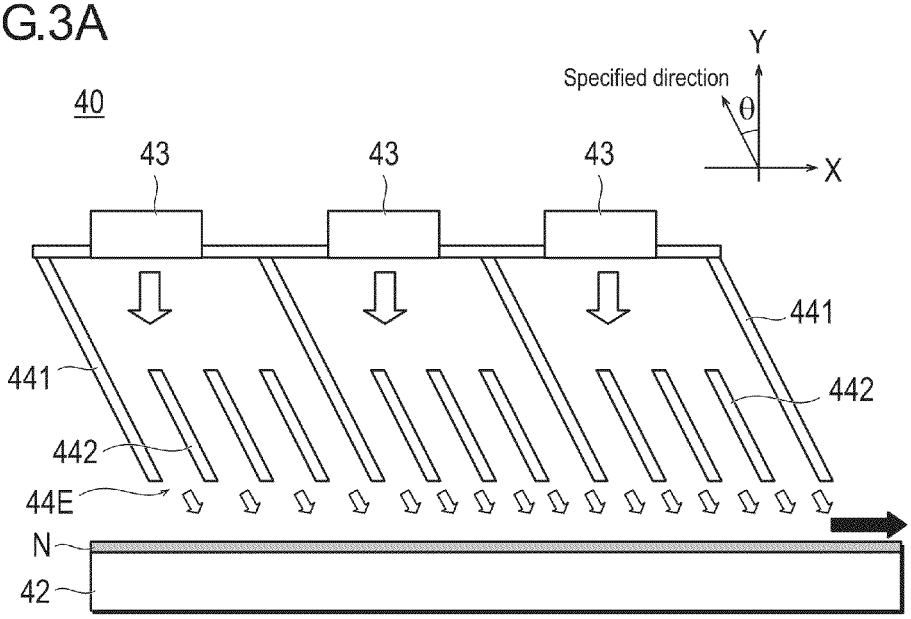
FIG. 3A is a rough plan view of the nozzle of the fixing part of the image forming apparatus according to a second embodiment of the present invention viewed in the same direction as in FIG. 2B.

FIG. 3A is a rough plan view of the nozzle of the fixing part of the image forming apparatus according to a second embodiment of the present invention viewed in the same direction as in FIG. 2B. The outer wall 44W of the nozzle is not shown in FIG. 3A for the convenience of describing the internal structure of the nozzle. As shown in FIG. 3A, the primary and secondary ribs 441 and 442 are formed in the specified direction from the air ejection port 44E of the nozzle 44 to a specified position inside the nozzle 44. If the angle that is formed between the specific direction and the paper transport direction (Y-direction in FIG. 3A) is called θ degrees, θ can be set less than 90 degrees. From the standpoint of effectively separating the printing paper S, θ should preferably be set at less than 40 degrees.

In the nozzle 44 of such a construction, the air sent out by the fan 43 is ejected from the air ejection port 44E while its velocity is increased inside the nozzle 44, and impinges diagonally upon the printing paper S at the paper outlet of the nipping part N. As a result, most of the air reflected from the printing paper S at the paper outlet port of the nipping part N flows toward the right side of the paper surface in FIG. 3A along the longitudinal direction of the pressure roller 42 (X direction in FIG. 3A), mixes with the air inside the fixing part 40, and is exhausted to the outside of the fixing part 40 with the help of the exhaust fan 46. In the present embodiment, a total of four primary ribs 441 and a total of nine secondary ribs 442 are formed.

[Embodiment]

Figure 3B:
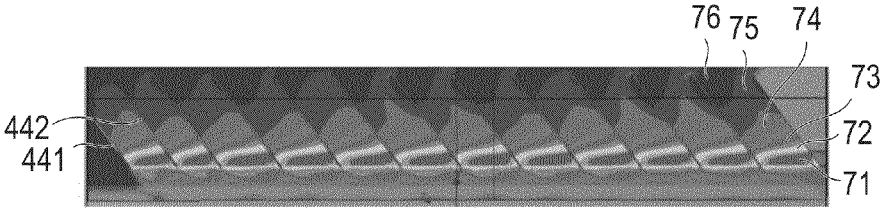
FIG. 3B is a velocity distribution diagram of the air velocity inside the nozzle according to a simulation result using a nozzle with a structure shown in FIG. 3A.

FIG. 3B is a velocity distribution diagram of the air velocity inside the nozzle according to a simulation result using a nozzle with a structure shown in FIG. 3A. In FIG. 3B, the air velocity is color-coded into red, yellow, green, pale blue, blue, and dark blue in the order of higher velocity, corresponding to codes 71-76 respectively. In the present embodiment, a simulation was conducted assuming the angle θ of the primary and secondary ribs 441 and 442 relative to the paper transport direction to be 30 degrees.

As a result, the air velocity reached its maximum of approximately 50 m/s at the vicinity of the air ejection port 44E of the nozzle 44 (see the red portion 71 of FIG. 3B). The air velocity was also higher than 10 m/s at the paper outlet of the nipping part N, three times higher than in the case when the first and second ribs 441 and 442 were not formed in the nozzle 44. At air velocities higher than 10 m/s. it is possible to separate the printing paper S from the heating roller 41 without fail.

As can be seen from the above, the image forming apparatus 100 according to the present embodiment causes the air that impinges upon the printing paper S at the paper outlet port of the nipping part N to flow along the longitudinal direction of the pressure roller 42, thus securing the flow that is exhausted to the outside of the fixing part 40. Consequently, it can suppress the rise of the air pressure in the space between the heating roller 41, as well as the pressure roller 42, and the nozzle 44. As a result, the reduction of the air velocity that impinges upon the printing paper S can be effectively prevented so that the printing paper S can be securely separated from the heating roller 41.

Moreover, it makes it possible to suppress the heat dispersion inside the image forming apparatus 100 as the air flow direction can be controlled by the first and second ribs 441 and 442.

(Third Embodiment)

In the first and second embodiments discussed, a case was described wherein the spacing among the second ribs is generally uniform in the paper transport direction. In the third embodiment, a case will be described wherein the spacing between the second ribs becomes narrower as it approaches the air ejection port. In the following, the descriptions of the compositions similar to those of the first and second embodiments will be omitted in order to avoid duplications.

Figure 4A:
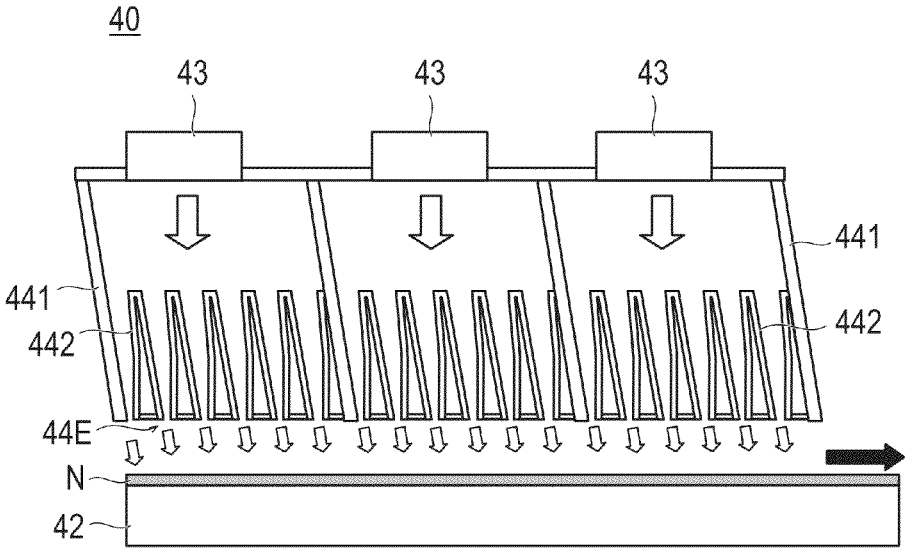
FIG. 4A is a rough plan view of a nozzle of the fixing part of the image forming apparatus according to a third embodiment of the present invention viewed in the same direction as in FIG. 2B.

FIG. 4A is a rough plan view of a nozzle of the fixing part of the image forming apparatus according to a third embodiment of the present invention viewed in the same direction as in FIG. 2B. The outer wall 44W of the nozzle is not shown in FIG. 4A for the convenience of describing the internal structure of the nozzle. As shown in FIG. 4A, the primary ribs 441 are formed at a specific angle relative to the paper transport direction, while the wedge-shaped secondary ribs 442 are formed in such a manner as to cause the spacing between the secondary ribs 442 to become narrower as it approaches the air ejection port 44E. Consequently, the velocity of the air ejecting out of the air ejection port 44E can be faster than in other cases.

In the present embodiment, the air pressure of the space formed by the primary and secondary ribs 441 and 442 between the nozzle 44 and the nipping part N is lower than the air pressure where the primary and secondary ribs 441 and 442 are not formed. In particular, the air pressure in the area where the secondary ribs are formed is lower than the pressures of other areas. Consequently, the air ejected from the air ejection port 44E impinges upon the printing paper S at the paper outlet port of the nipping part N and reflects from it to advance further to the secondary ribs 442 of the nozzle 44, flows along the outer wall of the nozzle 44, and mixes with the air inside the fixing part 40. Moreover, a portion of the reflected air flows along the longitudinal direction of the pressure roller 42 and mixes with the air inside the fixing part 40. The air inside the fixing part 40 is then exhausted to the outside of the fixing part 40, by means of an exhaust fan 46.

[Embodiment]

Figure 4B:
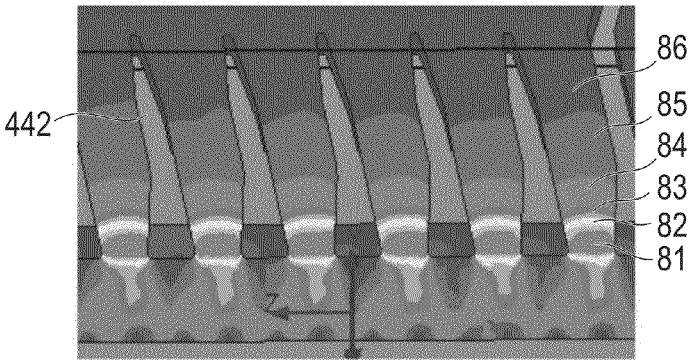
FIG. 4B is a velocity distribution diagram of the air velocity inside the nozzle according to a simulation result using a nozzle with a structure shown in FIG. 4A.

FIG. 4B is a velocity distribution diagram of the air velocity inside the nozzle according to a simulation result using a nozzle with a structure shown in FIG. 4A. In FIG. 4B, the air velocity is color-coded into red, yellow, green, pale blue, blue, and dark blue in the order of higher velocity, corresponding to codes 81-86 respectively. In the present embodiment, a simulation was conducted assuming the angle of the primary and secondary ribs 441 and 442 relative to the paper transport direction to be 12 degrees. As a result, the air velocity reached its maximum of approximately 50 m/s at the vicinity of the air ejection port 44E of the nozzle 44. The air velocity in the paper outlet area of the nipping part N was over 10 m/s.

Figure 4C:
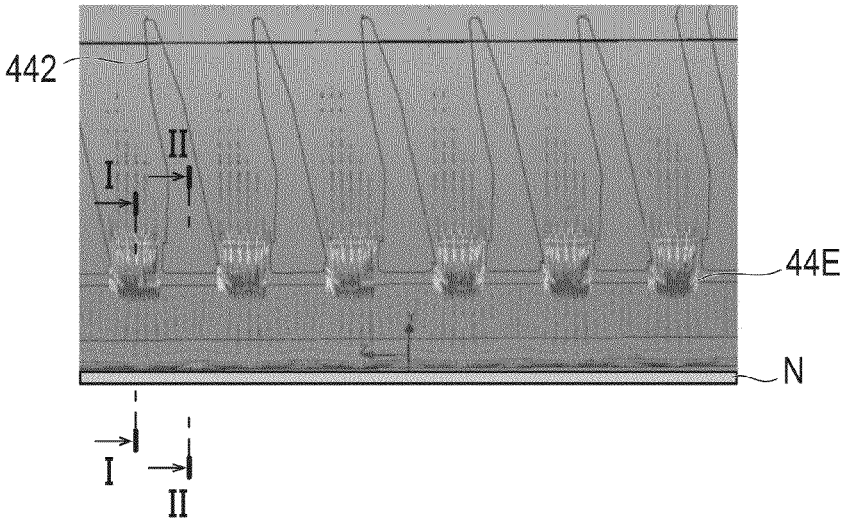
FIG. 4C is a diagram showing the air flow in the simulation of FIG. 4B.

FIG. 4C is a diagram showing the air flow in the simulation of FIG. 4B. In FIG. 4B, the air flow is shown by lines color-coded into red, yellow, green, pale blue, blue, and dark blue in the order of higher velocity.

As shown in FIG. 4C, the air ejected from the air ejection port 44E impinges upon the paper outlet port of the nipping part N and reflects from it to flow to return to the secondary ribs 442 of the nozzle 44 (see the arrows of FIG. 4C).

Figure 4D:
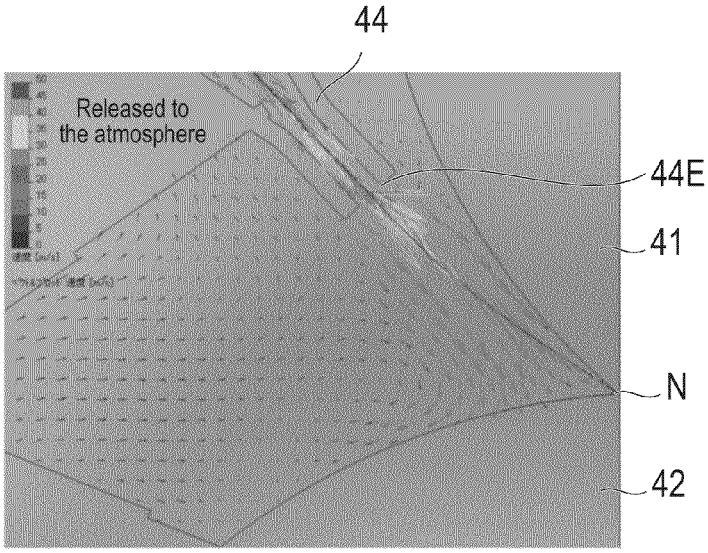
FIG. 4D is a diagram showing the air flow in a cross section along the I-I line shown in FIG. 4C.
Figure 4E:
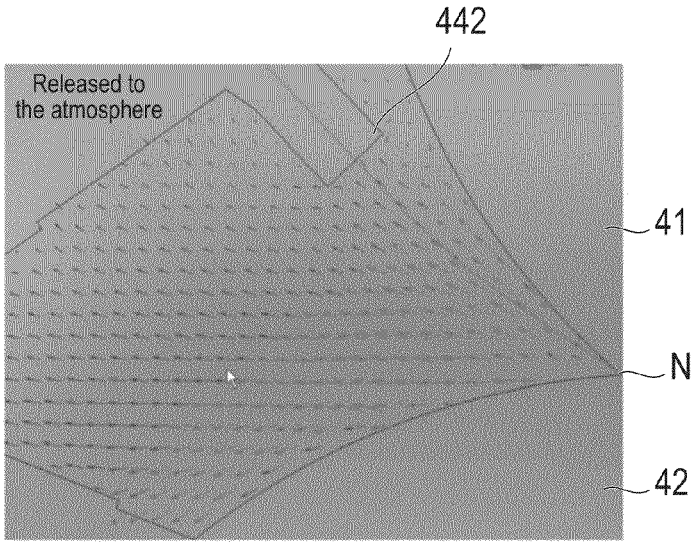
FIG. 4E is a diagram showing the air flow in a cross section along the II-II line shown in FIG. 4C.

FIG. 4D is a diagram showing the air flow in a cross section along the line shown in FIG. 4C, while FIG. 4E is a diagram showing the air flow in a cross section along the II-II line shown in FIG. 4C. In FIG. 4D and FIG. 4E, the air flow is shown by lines color-coded into red, yellow, green, pale blue, blue, and dark blue in the order of higher velocity.

As shown in FIGS. 4D and 4E, the air ejected from the air ejection port 44E impinges upon the paper outlet port of the nipping part N and reflects from it to flow to return to the secondary ribs 442 of the nozzle 44. Moreover, in the present embodiment, the simulation was conducted assuming that the air returning to the secondary ribs 442 of the nozzle 44 is released to the atmosphere.

As can be seen from the above, the present embodiment provides the following effects in addition to the effects provided by the first and second embodiments.

According to the image forming apparatus 100 of the present embodiment, the velocity of the air ejected from the air ejection port 44E can be made further faster as the secondary ribs 442 are formed in such a manner as to make the spacing between the secondary ribs 442 becomes narrower as it approaches the air ejection port 44E. It can also secure the air flow reflected at the paper outlet of the nipping part N to return to the secondary ribs 442 of the nozzle 44.

(Fourth Embodiment)

In the first embodiment, a case was described wherein the air reflected at the paper outlet of the nipping part flows along the outer wall of the nozzle, mixes with the air inside the fixing part, and is discharged to the outside of the fixing part. In the fourth embodiment, a case will be described wherein the air reflected at the paper outlet of the nipping part is discharged to the outside of the fixing part via the air suction port formed at the tip of the secondary ribs. In the following, the descriptions of the compositions similar to those of the first embodiment will be omitted in order to avoid duplications.

Figure 5A:
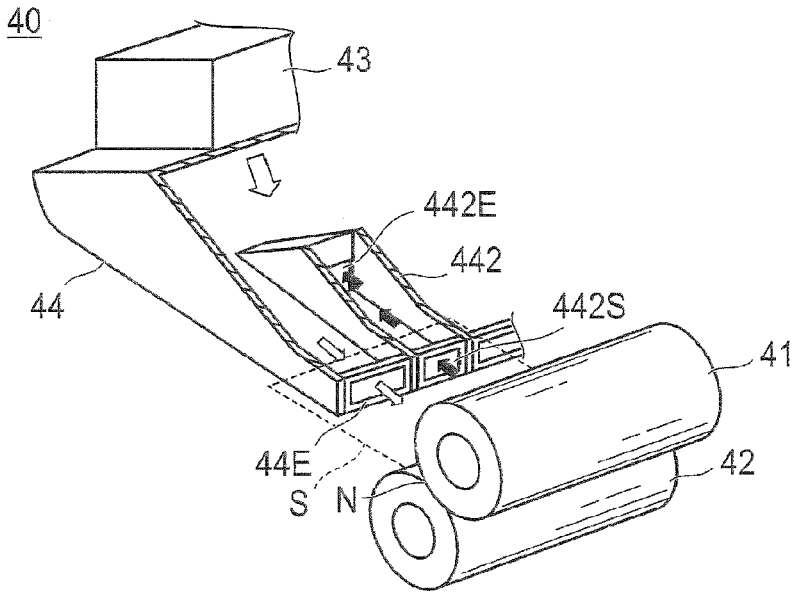
FIG. 5A is a rough perspective view for describing the nozzle of the fixing part of the image forming apparatus according to a fourth embodiment of the present invention.
Figure 5B:
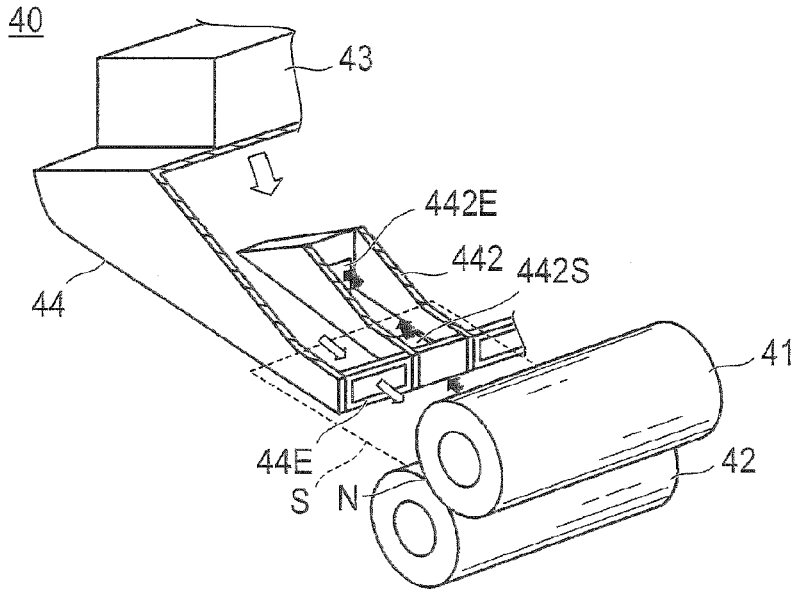
FIG. 5B is a rough perspective view for describing a variant of the fourth embodiment of the present invention.

FIG. 5A is a rough perspective view for describing the nozzle of the fixing part of the image forming apparatus according to the fourth embodiment of the present invention, while FIG. 5B is a rough perspective view for describing a variant of the fourth embodiment of the present invention. As shown in FIG. 5A, an air suction port 442S is formed at the tip of the secondary ribs 442, where the air suction port 442S communicates with an air discharge port 442E formed on the nozzle 44. The air discharge port 442E communicates with the outside of the fixing part 40 via a ventilation tube (not shown). The nozzle 44 having such a structure allows the air to flow from the space between the air suction port 442S and the nipping part N to the outside of the fixing part 40 via the air suction port 442S and the air suction port 44E.

[Variant Example]

The description above was for a case where the air reflected at the paper outlet of the nipping part N is discharged to the outside of the fixing part 40 via the air suction port 4425 formed at the tip of the secondary ribs 442. In the variant example here, the description will be for a case where the air reflected at the paper outlet of the nipping part N is discharged to the outside of the fixing part 40 via the air suction port 442S formed at a plane of the secondary ribs 442 facing the printing paper.

As shown in FIG. 5B, in the present embodiment, an air suction port 442S is formed on one of the surfaces of the secondary ribs 442 facing the printing paper S that passes through the nipping part N, where the air suction port 442S communicates with the air discharge port 442E formed on the nozzle 44. The air discharge port 442E communicates with the outside of the fixing part 40 via a ventilation tube (not shown). Consequently, the air flows from the space between the air suction port 442S and the nipping part N to the outside of the fixing part 40 via the air suction port 442S and the air discharge port 442E.

As can be seen from the above, the present embodiment provides the following effects in addition to the effects provided by the first embodiment.

The image forming apparatus 100 according to the present embodiment sucks the air in the space between the air suction port 442S and the nipping part N via the air suction port 442S formed at the secondary ribs 442, and discharges it to the outside of the fixing part 40 via the ventilation pipe. Consequently, it can efficiently discharge the air reflection from the paper outlet port of the nipping part N. As a result, it can suppress the violent behavior of the printing paper S and improve the paper separation performance of the fixing apparatus 40.

(Fifth Embodiment)

In the fourth embodiment, a case was described wherein the air of the space between the air suction port and the nipping part is sucked by the air suction port formed at the tip of the secondary ribs or on the surface facing the printing paper, and is discharged outside of the fixing part via the ventilation tube. In the fifth embodiment, a case will be described wherein the air sucked by the air suction port formed on the secondary ribs is sucked by a fan and sent out again via the nozzle. In the following, the descriptions of the compositions similar to those of the fourth embodiment will be omitted in order to avoid duplications.

Figure 6A:
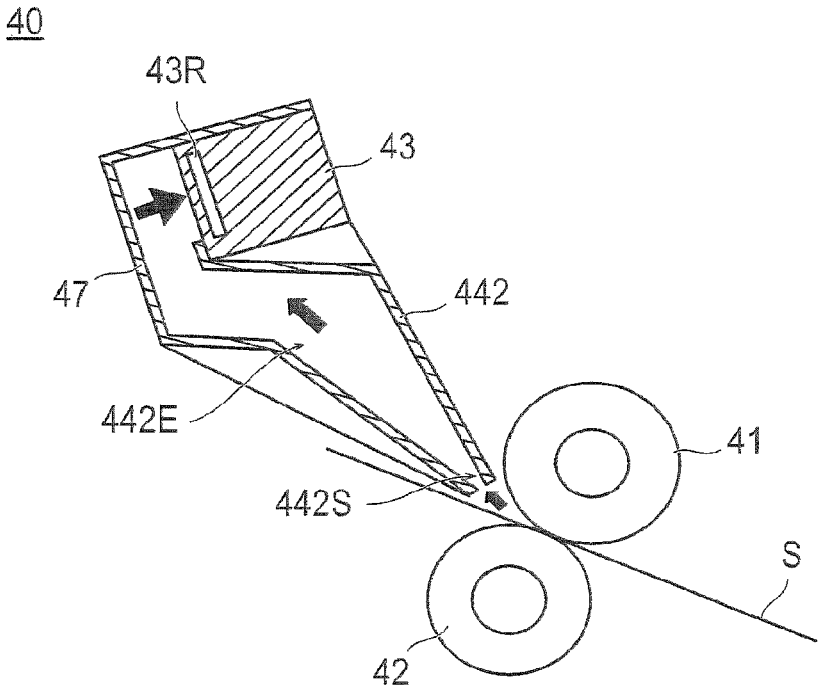
FIG. 6A is a rough cross-sectional view of a nozzle of the fixing part of the image forming apparatus according to a fifth embodiment of the present invention viewed in the same direction as in FIG. 2A.
Figure 6B:
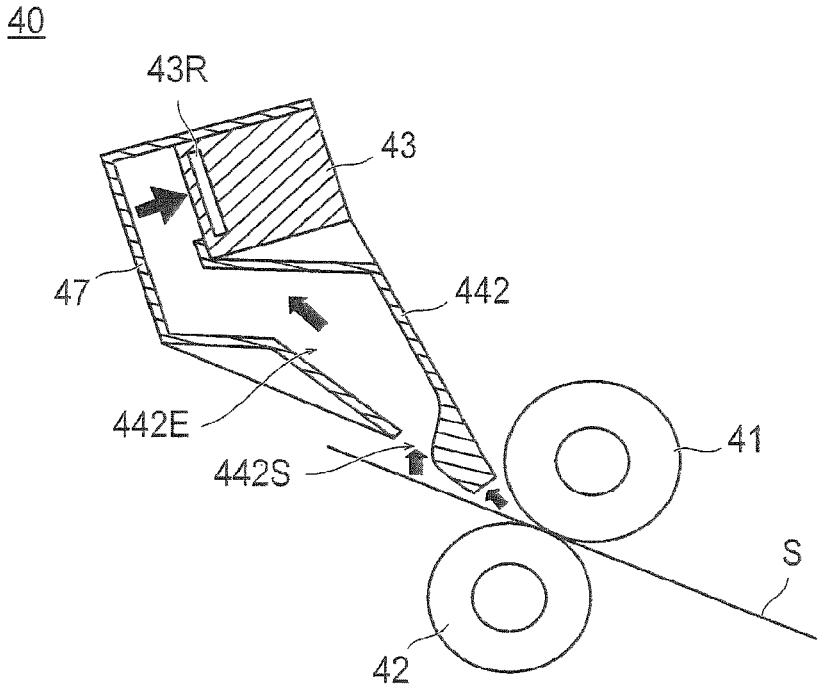
FIG. 6B is a rough cross-sectional view of a variant of the fifth embodiment of the present invention viewed in the same direction as in FIG. 2A.

FIG. 6A is a rough perspective view for describing the nozzle of the fixing part of the image forming apparatus according to the fifth embodiment of the present invention viewed in the same direction as in FIG. 2A, while FIG. 6B is a rough perspective view for describing a variant of the fifth embodiment of the present invention viewed in the same direction as in FIG. 2A.

As shown in FIG. 6A, an air suction port 442S is formed at the tip of the secondary ribs 442, where the air suction port 442S communicates with an air discharge port 442E formed on the nozzle 44. The air discharge port 442E communicates via the ventilation tube 47 with the fan suction port 43R of the fan 43 provided for sending out the air to the nozzle 44. As a result, the air in the space between the air suction port 442S and the nipping part N is sucked by the fan 43 via the air suction port 442S. The sucked air is again sent out to the nozzle 44.

Variant Example

As shown in FIG. 6B, in this variant case, an air suction port 442S is formed on the surface facing the printing paper of the secondary ribs 442, where the air suction port 442S communicates with an air discharge port 442E formed on the nozzle 44. The air discharge port 442E communicates via the ventilation tube 47 with the fan suction port 43R of the fan 43 provided for sending out the air to the nozzle 44. As a result, the air in the space between the air suction port 442S and the nipping part N is sucked by the fan 43 via the air suction port 442S. The sucked air is again sent out to the nozzle 44.

As can be seen from the above, the present embodiment provides the following effects in addition to the effects provided by the fourth embodiment.

According to the image forming apparatus 100 of the present embodiment, the air heated by the heating roller 41 is used for the paper separation, it can attenuate the tendency of the air ejected from the nozzle 44 removes the heat from the printing paper S when it separates the paper. Consequently, it prevents luster variations to be generated on the image fixed on the printing paper S. As a result, it becomes unnecessary to provide a means of heating the air inside the fixing device 40 so that the energy efficiency of the fixing apparatus 40 can be improved.

Sixth Embodiment

In the second embodiment, a case was described wherein the air reflected at the paper outlet of the nipping part flows along the longitudinal direction of the pressure roller, mixes with the air inside the fixing part, and is discharged to the outside of the fixing part. In the sixth embodiment, a case was described wherein the air reflected at the paper outlet of the nipping part flows along the longitudinal direction of the pressure roller, and is discharged to the outside of the image forming apparatus via the ventilation tube. In the following, the descriptions of the compositions similar to those of the second embodiment will be omitted in order to avoid duplications.

Figure 7:
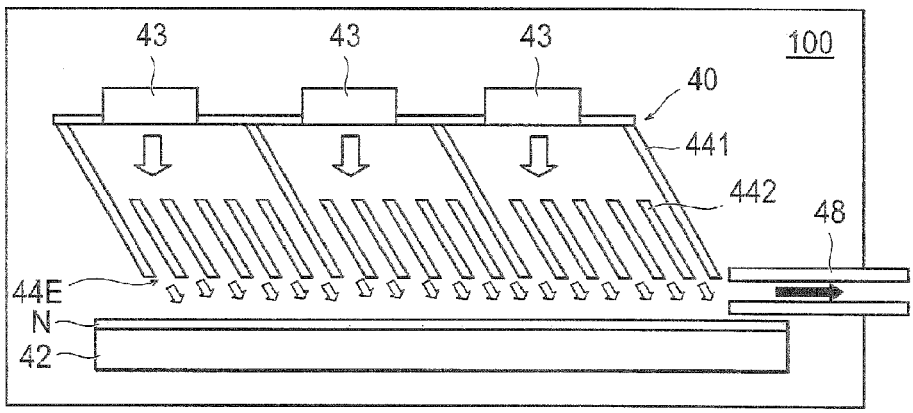
FIG. 7 is a rough plan view of the nozzle of the fixing part of the image forming apparatus according to a sixth embodiment of the present invention viewed in the same direction as in FIG. 2B.

FIG. 7 is a rough plan view of the nozzle of the fixing part of the image forming apparatus according to a sixth embodiment of the present invention viewed in the same direction as in FIG. 2B. The outer wall 44W of the nozzle is not shown in FIG. 7 for the convenience of describing the internal structure of the nozzle. As shown in FIG. 7, the fixing part 40 of the present embodiment has a ventilation tube 48 that connects the space between the nozzle 44 and the nipping part N with the outside of the image forming apparatus 100.

The air sent out by the fan 43 is ejected from the air ejection port 44E while its velocity is increased inside the nozzle 44, and impinges diagonally upon the printing paper S at the paper outlet of the nipping part N. As a result, most of the air reflected at the paper outlet of the nipping part N flows to the right side in FIG. 7 along the longitudinal direction of the pressure roller 42, and is discharged to the outside of the image forming apparatus 100 via the ventilation tube 48. The area where the ventilation tube 48 communicates with does not have to be limited to the outside of the image forming apparatus 100, but rather can be any area which is not affected by the heat inside the image forming apparatus 100.

As can be seen from the above, the present embodiment provides the following effects in addition to the effects provided by the second embodiment.

According to the image forming apparatus 100 of the present embodiment, the air reflected at the paper outlet port of the nipping part N can be directed for discharge, so that the air can be discharged more efficiently without losing the heat inside the image forming apparatus 100.

(Seventh Embodiment)

In the second embodiment, a case was described wherein the air reflected at the paper outlet of the nipping part flows along the longitudinal direction of the pressure roller, mixes with the air inside the fixing part, and is discharged to the outside of the fixing part. In the seventh embodiment, a case will be described wherein the air reflected at the paper outlet of the nipping part flows along the longitudinal direction of the pressure roller, and is sucked into the suction port of the fan that sends out the air to the nozzle via the ventilation tube. In the following, the descriptions of the compositions similar to those of the second embodiment will be omitted in order to avoid duplications.

Figure 8:
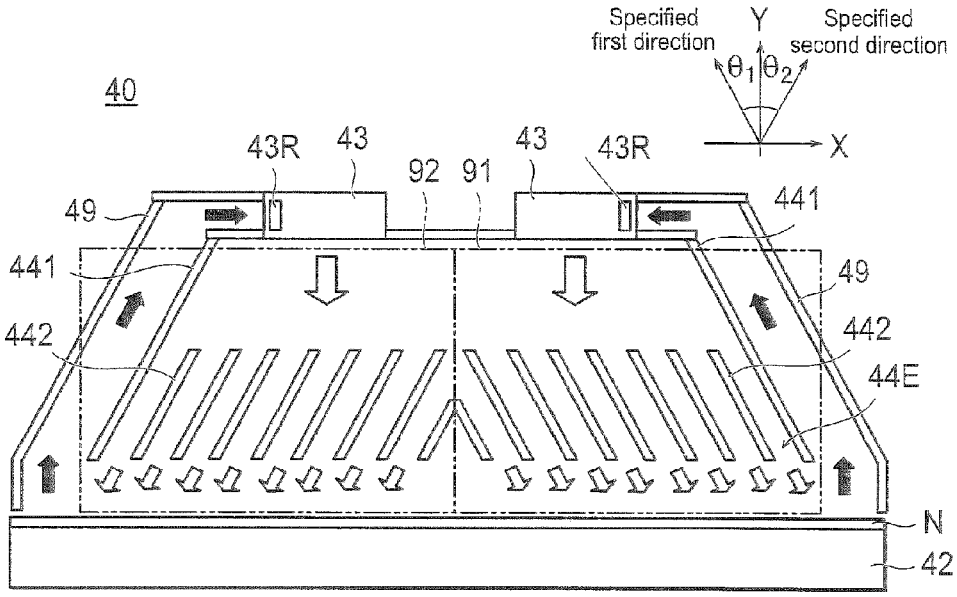
FIG. 8 is a rough plan view of the fixing part of the image forming apparatus according to a seventh embodiment of the present invention viewed in the same direction as in FIG. 2B.

FIG. 8 is a rough plan view of a nozzle of the fixing part of the image forming apparatus according to a seventh embodiment of the present invention viewed in the same direction as in FIG. 23. The outer wall 44W of the nozzle is not shown in FIG. 8 for the convenience of describing the internal structure of the nozzle. It is also assumed here that the internal space of the nozzle 44 is divided into two areas, first and second areas 91 and 92 respectively for the sake of convenience of description. As shown in FIG. 8, in the present embodiment, the two fans 43 send the air into the first and second areas 91, and 92. In the first area 91, the primary and secondary ribs 441 and 442 are formed in the specified first direction from the air ejection port 44E of the nozzle 44 to a specified position inside the nozzle 44. On the other hand, in the second area 92, the primary and secondary ribs 441 and 442 are formed in the specified second direction from the air ejection port 44E of the nozzle 44 to a specified position inside the nozzle 44.

The angle θ1 (degree) between the first direction and the printing paper transport direction (Y-direction in FIG. 8) and the θ2 (degree) between the second direction and the printing paper transport direction are both set at angles less than 90 degrees. From the standpoint of effectively separating the printing paper S, θ1 and θ2 should preferably be set at less than 40 degrees.

In the present embodiment, a ventilation tube 49 that connects the space between the nozzle 44 and the nipping part N with the fan suction port 43R of the fan 43 that sends out the air to the nozzle 44 is provided for each of the first and second areas 91 and 92.

In the nozzle 44 of such a construction, the air sent out by the fan 43 is ejected from the air ejection port 44E while its velocity is increased inside the nozzle 44, and impinges diagonally upon the printing paper S at the paper outlet of the nipping part N. As a result, most of the air reflected at the paper outlet of the nipping part N flows to the right side as well as to the left side in FIG. 8 along the longitudinal direction of the pressure roller 42, and is sucked up by the fan 43 via the ventilation tube 49. The air sucked up the fan 43 is again ejected from the air ejection port 44E after increasing its velocity inside the nozzle 44.

As can be seen from the above, the present embodiment provides the following effects in addition to the effects provided by the second embodiment.

According to the image forming apparatus 100 of the present embodiment, the air heated by the heating roller 41 is used for the paper separation, it can attenuate the tendency of the air ejected from the nozzle 44 removes the heat from the printing paper S when it separates the paper. Consequently, it prevents luster variations to be generated on the image fixed on the printing paper S. As a result, it becomes unnecessary to provide a means of heating the air inside the fixing device 40 so that the energy efficiency of the fixing apparatus 40 can be improved.

Such is the configurations of the image forming apparatuses according to these embodiments. However, it goes without saying that the present invention can arbitrarily added, modified and omitted by a person skilled in the art within the gist of the technology disclosed herein.

For example, in the embodiments first through sevenths presented above, cases of using two or three fans for sending the air to the nozzle. However, the number of fans to be used can be one or more than four. Also, the number of the primary and secondary ribs can be arbitrarily chosen considering the number of fans.

Also, in the first through seventh embodiments presented above, a case is described wherein the width of the nozzle is wider than the width of the printing paper. However, the width of the nozzle can be either the same or narrower than the width of the printing paper.

What is claimed is:

1. An image forming apparatus comprising:

a fixing member that fixes an image by heating and applying a pressure to a sheet of printing paper on which a toner image is transferred, while the sheet of printing paper is being transported; and a paper separation part having a blower part and an air ejecting part that ejects air sent out from said blower part against a paper outlet port of a nipping part of said fixing member;

wherein said air ejection part has ribs that divides an air flow sent out from said blower part; and said ribs comprise an air sucking port to suck the air in the space between said paper separation part and said nipping part's paper outlet port.

2. The image forming apparatus claimed in claim 1, wherein said ribs are formed in an angle relative to said printing paper's transport direction at least in one direction, right or left, when seen in a plan view of the printing paper.

3. The image forming apparatus claimed in claim 1, wherein said air sucking port is formed on one side of said ribs facing the printing paper that passes through said nipping part.

4. The image forming apparatus claimed in claim 1, wherein said air sucking port is connected with the air sucking port of said blower part.

5. The image forming apparatus claimed in claim 1 further comprising:

a ventilation tube for ejecting the air in the space between said paper separation part and said nipping part's paper outlet port to the outside of said image forming apparatus.

6. The image forming apparatus claimed in claim 1 further comprising:

a ventilation tube for connecting the space between said paper separation part and said nipping part's paper outlet port with the air sucking port of said blower part.

7. The image forming apparatus claimed in claim 1, wherein the air ejected toward the paper outlet port of the nipping part of said fixing member flows along the image forming part of said image forming apparatus after it is reflected at said paper outlet of said nipping part until it is ejected to the outside of said image forming apparatus.

* * * * *